US006447434B1

(12) United States Patent
Waters

(10) Patent No.: US 6,447,434 B1
(45) Date of Patent: Sep. 10, 2002

(54) PORTABLE EXERCISE APPARATUS

(76) Inventor: Anthony Waters, 1450 NW. 114th St., Miami, FL (US) 33167

( * ) Notice: Subject to any disclaimer, the term of this patent is extended or adjusted under 35 U.S.C. 154(b) by 0 days.

(21) Appl. No.: 09/362,222

(22) Filed: Jul. 28, 1999

(51) Int. Cl.[7] ..... A63B 21/00

(52) U.S. Cl. ..... 482/140; 482/51; 482/52

(58) Field of Search ..... 482/91, 140, 51, 482/52, 148, 72, 907, 130

(56) References Cited

U.S. PATENT DOCUMENTS 4,257,591 A * 3/1981 Evans, Sr. ..... 482/140
5,290,210 A * 3/1994 Hand et al. ..... 482/51
5,910,074 A * 6/1999 Purdie ..... 482/141

* cited by examiner

*Primary Examiner*—Jerome W. Donnelly
(74) *Attorney, Agent, or Firm*—Cuspa Technology Law Associates

(57) ABSTRACT

A portable exercise apparatus comprising a footrest and an adjustable, elongate bar. The footrest includes a substantially flat top face, a pair of longitudinally disposed sidewalls projecting downwards and outward from opposite longitudinally disposed edges of the top face and a pair of opposing endwalls. The bar is comprised of an inner and outer tubular members arranged telescopically. Adjustment holes are provided along the length of the inner and outer tubular members and are structured to receive a pair of tubular-shaped handles to retain the inner and outer members at their desired respective positions and to provide a means for gripping the bar. When not in use, the bar may be secured to the footrest by removing one of the handles from the bar, inserting the end of the bar without the handle through holes in the endwalls and then replacing the handle on the bar. In use, each person is seated on opposite sides of the footrest, facing each other, with their feet up against the inclined sidewalls. With the bar adjusted in length to approximate the distance between the extended arms of the two people when one is lying prone on his back and the other is sitting upright, each person grips the handle on their respective end of the bar and the person sitting up reclines backward towards the prone position while pulling the other person upward to an upright sitting position. At the same time, the person who was initially reclining backwards utilizes his abdominal muscles to sit up. This process is repeated back and forth until the desired number of repetitions are completed.

8 Claims, 7 Drawing Sheets

PORTABLE EXERCISE APPARATUS

FIELD OF THE INVENTION

The present invention relates to exercise equipment and, more particularly, to a portable exercise apparatus which enables two people to perform sit-ups together.

BACKGROUND

Over the past several years, numerous types of exercise equipment have been developed. Such prior art equipment typically provides means for an individual to perform one or more physical exercises for body tone, muscle building, heart conditioning, lung development and other like purposes. Many of these prior art devices are large, bulky and cumbersome and, consequently, generally stationary equipment. Necessarily, then, such devices take up a fair amount of space and are not suitable for persons without extra space in their home or office. Moreover, such devices are not suitable for persons desiring to use the equipment in more than one location.

Several portable exercise devices have been developed over the years. However, such devices are, typically, limited to a specific exercise are, consequently, limited in overall effectiveness. Moreover, such prior art portable exercise equipment oftentimes must be stabilized in some manner, such as by securing it to the ground or to some other fixed object. This is sometimes difficult and time consuming and may cause damage to the object to which the equipment is being secured.

A common complaint of many exercisers is the boredom associated with performing repetitive acts for a length of time. Such boredom is an inherent problem for individualized exercises. On the otherhand, exercise routines involving two or more people, such as tennis or racketball, do not suffer from this problem and, consequently, people are more apt to spend time performing such group exercise. However, most exercise equipment, especially portable exercise equipment, are structured to be used by only one person at a time.

Accordingly, there is a need in the art for portable exercise equipment which can be utilized by two or more people. Any such equipment should be lightweight, compact, inexpensive and easy to operate and transport. The present invention is particularly suited to address this need in a manner not previously contemplated.

SUMMARY OF THE INVENTION

The present invention is directed towards a new and improved portable exercise apparatus comprising a footrest and an adjustable, elongate bar. The footrest includes a substantially flat top face, a pair of longitudinally disposed sidewalls projecting downwards and outward from opposite longitudinally disposed edges of the top face and a pair of opposing endwalls. The bar is comprised of an inner and outer tubular members arranged telescopically. Adjustment holes are provided along the length of the inner and outer tubular members and are structured to receive a pair tubular-shaped handles to retain the inner and outer members at their desired respective positions and to provide a means for gripping the bar. When not in use, the bar may be secured to the footrest by removing one of the handles from the bar, inserting the end of the bar without the handle through holes in the endwalls and then replacing the handle on the bar. In use, each person is seated on opposite sides of the footrest, facing each other, with their feet up against the inclined sidewalls. With the bar adjusted in length to approximate the distance between the extended arms of the two people when one is lying prone on his back and the other is sitting upright, each person grips the handle on their respective end of the bar and the person sitting up reclines backward towards the prone position while pulling the other person upward to an upright sitting position. At the same time, the person who was initially reclining backwards utilizes his abdominal muscles to sit up. This process is repeated back and forth until the desired number of repetitions are completed.

It is an object of the present invention to provide a new and improved exercise apparatus having all the advantages of the prior art devices and none of the disadvantages.

It is another object of the present invention to provide a portable exercise apparatus.

It is also an object of the present invention to provide such an apparatus which can be utilized by two or more people.

It is a further object of the present invention to provide such an apparatus which is lightweight, compact, inexpensive and easy to operate and transport.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 2:
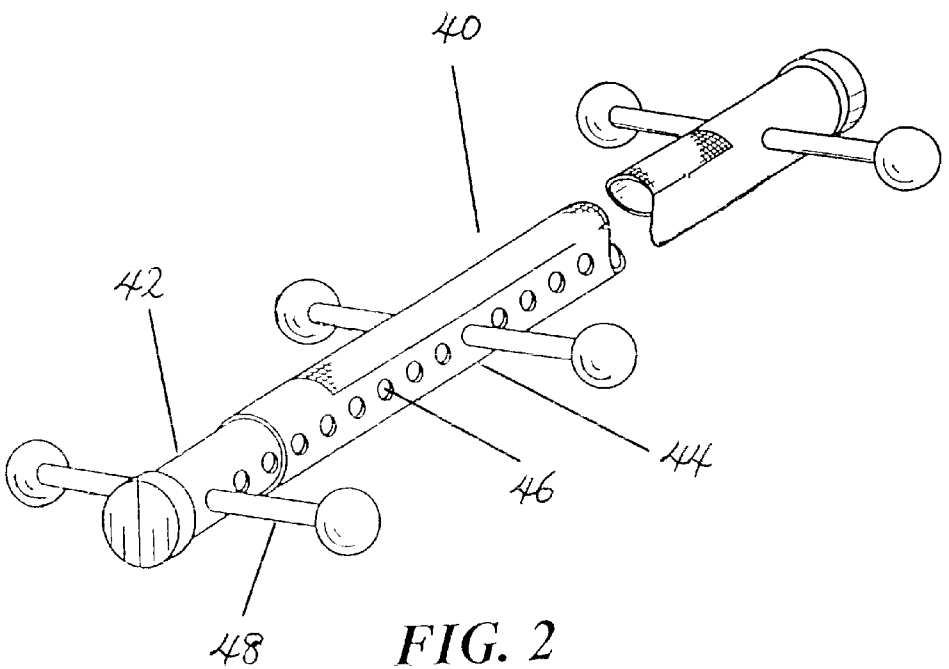
FIG. 2 is a perspective view of the bar, in partial section.
Figure 1A:
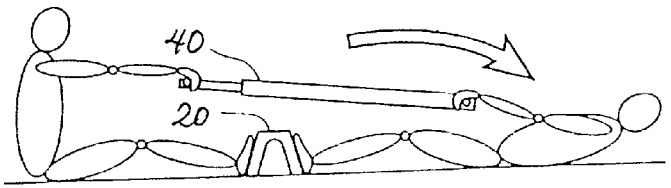
FIG. 1A is an end view of the present invention showing a first person in the prone position and the second person in the sitting position.
Figure 1B:
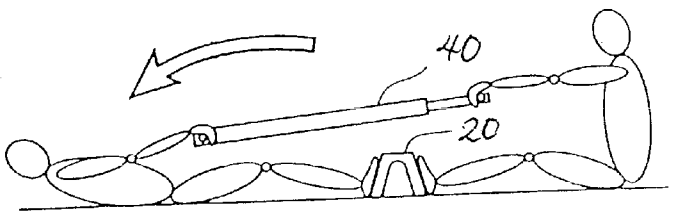
FIG. 1B is an end view of the present invention showing a second person in the prone position and the first person in the sitting position.
Figure 3:
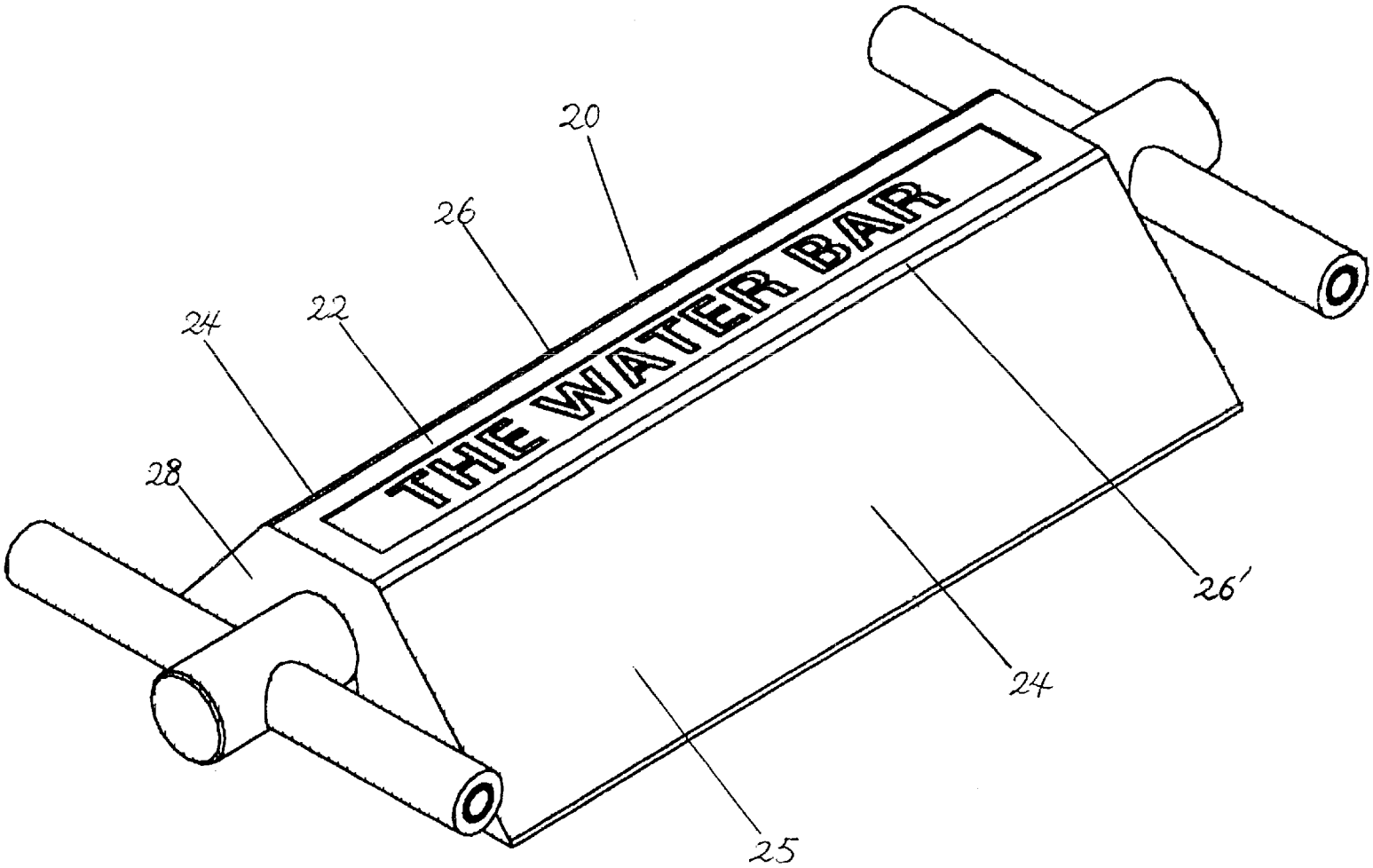
FIG. 3 is a perspective view of the present invention showing the bar secured within the footrest.
Figure 4:
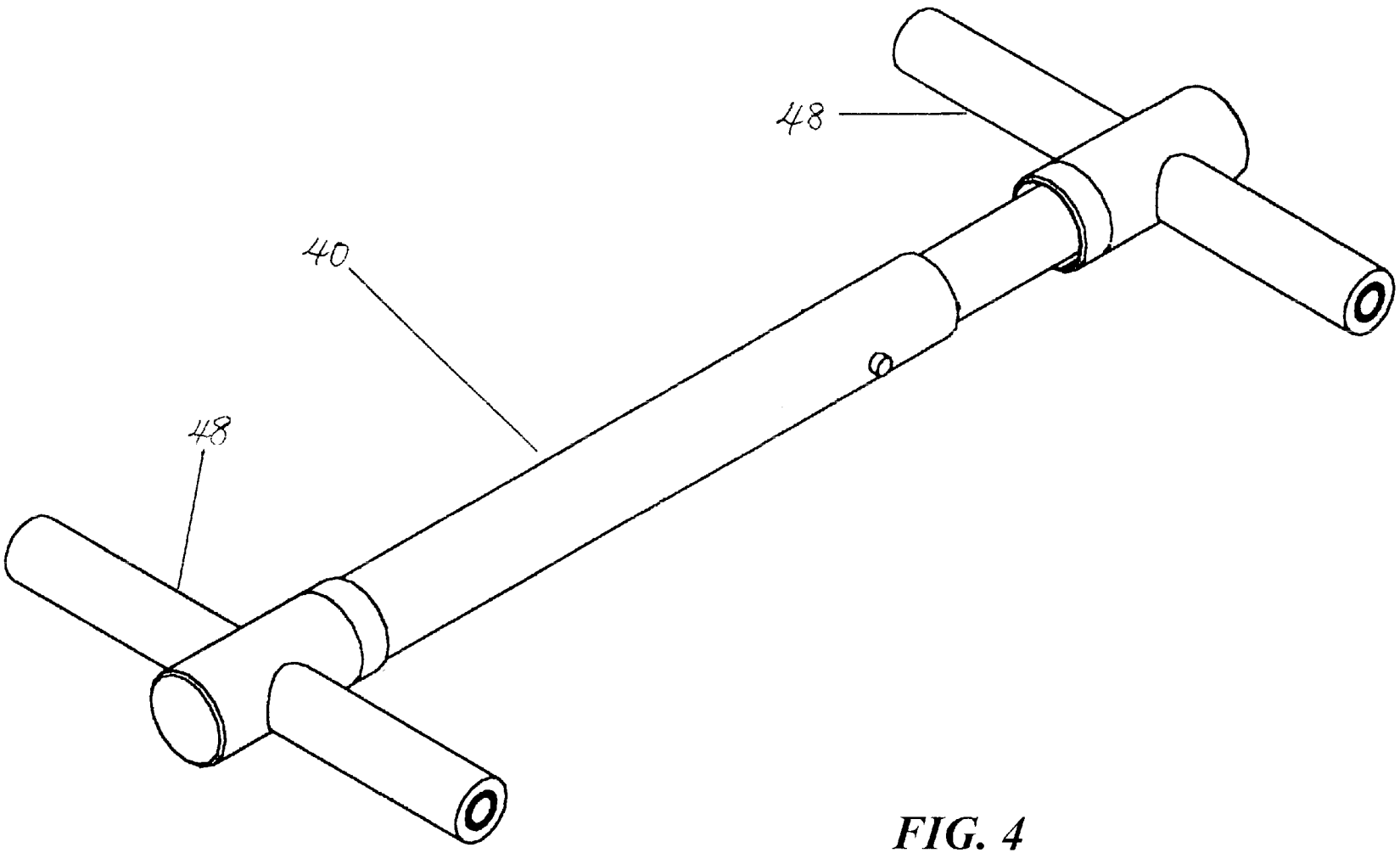
FIG. 4 is a perspective view of the present invention showing the bar in a retracted position.
Figure 5:
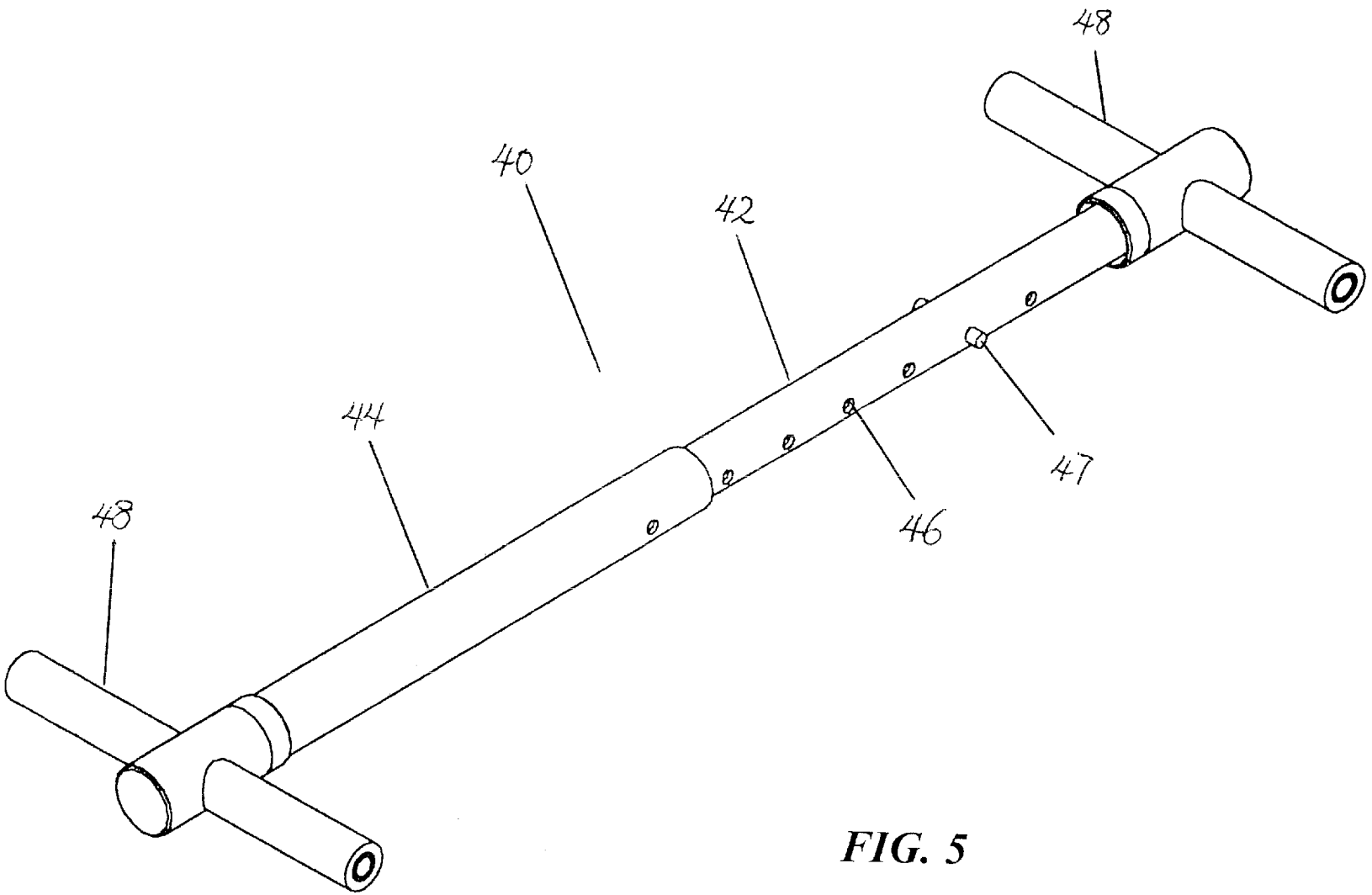
FIG. 5 is a perspective view of the present invention showing the bar in an extended position.
Figure 6:
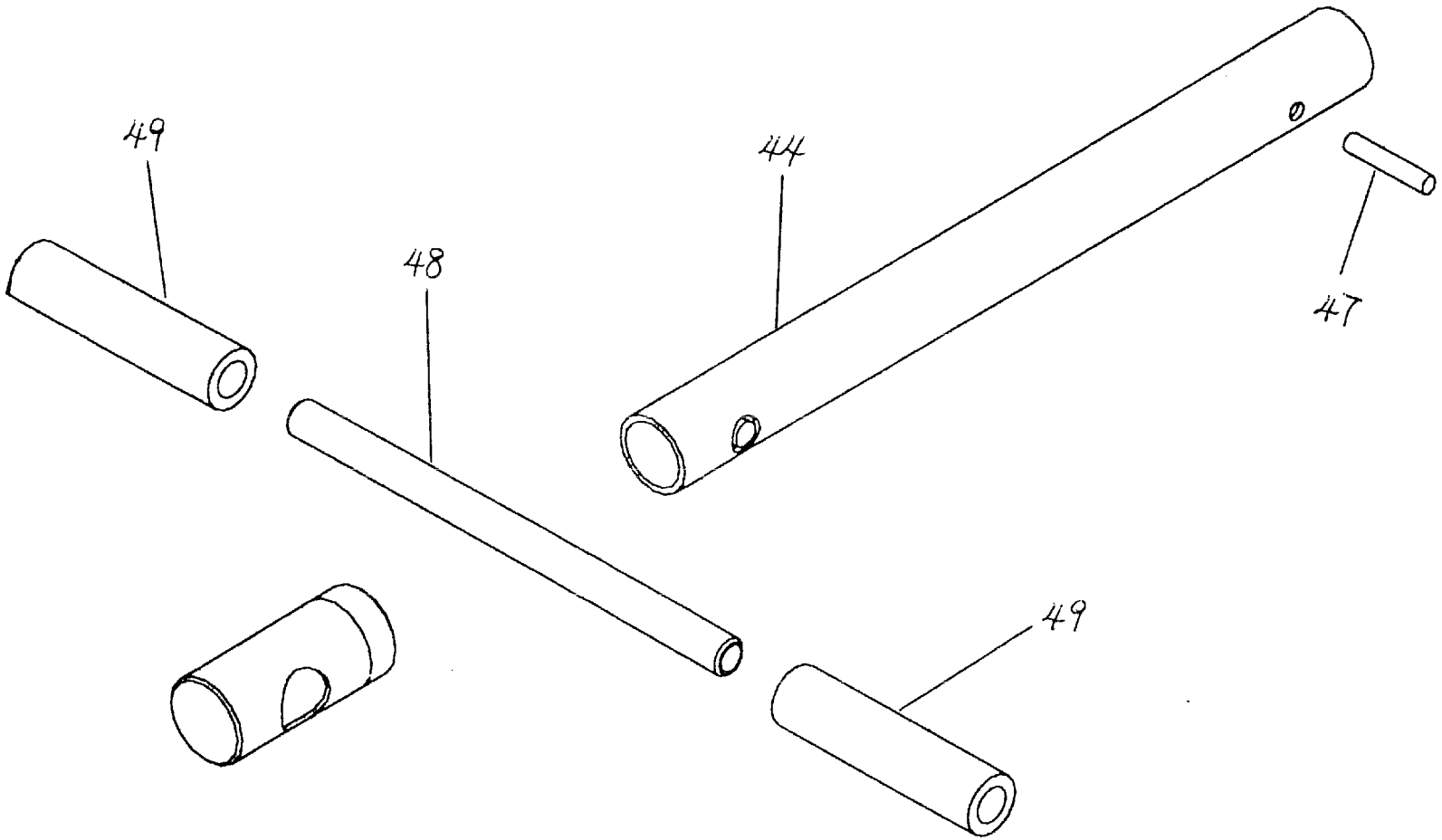
FIG. 6 is an exploded view of the bar and handle.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

As shown in FIGS. 1–8, the present invention is directed towards a new and improved portable exercise apparatus 10 comprising a footrest 20 and an adjustable, elongate bar 40. The footrest 20 includes a substantially flat top face 22, a pair of longitudinally disposed sidewalls 24 projecting downwards and outward from opposite longitudinally disposed edges 26, 26' of the top face 22 and a pair of opposing endwalls 28. The slope of the sidewalls 24 are at an angle which accommodates the natural at-rest position of the feet of the two people seated on opposite sides of the footrest 20. The endwalls 28 each include a generally centrally disposed hole 30.

The footrest 20 is structured to rest flat on a floor and is preferably constructed of a molded plastic of a one piece construction. However, the footrest 20 may, alternatively, be constructed of any other suitable material. Reinforcing ribs (not shown) may be appropriately located within the hollow interior of the footrest 20 to provide an overall light weight, yet provide the necessary stiffness to the structure. The inclined sidewalls 24 may be provided with striations parallel to the length of the footrest 20 to provide a slip-free surface. The outer surface 25 of the sidewalls 24 may additionally or alternatively be coated with a rubber-like, non-skid substance to further aid in providing a slip-free surface.

The bar 40 comprises an inner tubular member 42 and an outer tubular member 44 arranged telescopically. Adjustment holes 46 are provided along the length of the inner 42 and outer 44 tubular members so as to allow the users to adjust the length of the bar 40 to accommodate the particular height and reach of the exercisers. An outwardly biased pin 47 disposed within the inner member 42 retains the inner 42 and outer 44 members in place relative to one another. A tubular-shaped handle 48 is inserted through opposing holes 46 in the ends of the bar 40 to provide a means for gripping the bar 40. Foam or rubber gripping surfaces 49 may be provided over the handle 48 ends to facilitate gripping.

When not in use, the bar 40 may be secured to the footrest 20 by removing one of the handles 48 from the bar 40, inserting the end of the bar 40 without the handle 48 through the holes 30 in the endwalls 28 and then replacing the handle 48 on the bar 40. It should be appreciated that other suitable attachment means known in the art may, alternatively by employed to retain the bar 40 to the footrest for storage and transporting.

In use, each person is seated on the opposite sides of the footrest 20, facing each other, with their feet up against the inclined sidewalls 24. The bar 40 is adjusted in length to approximate the distance between the extended arms of the two people when one is lying prone on his back and the other is sitting upright. With each person gripping the handle 48 on their respective end of the bar 40, the person sitting up reclines backward towards the prone position while pulling the other person upward to an upright sitting position. At the same time, the person who was initially reclining backwards utilizes his abdominal muscles to sit up. This process is repeated back and forth until the desired number of repetitions are completed.

Figure 7:
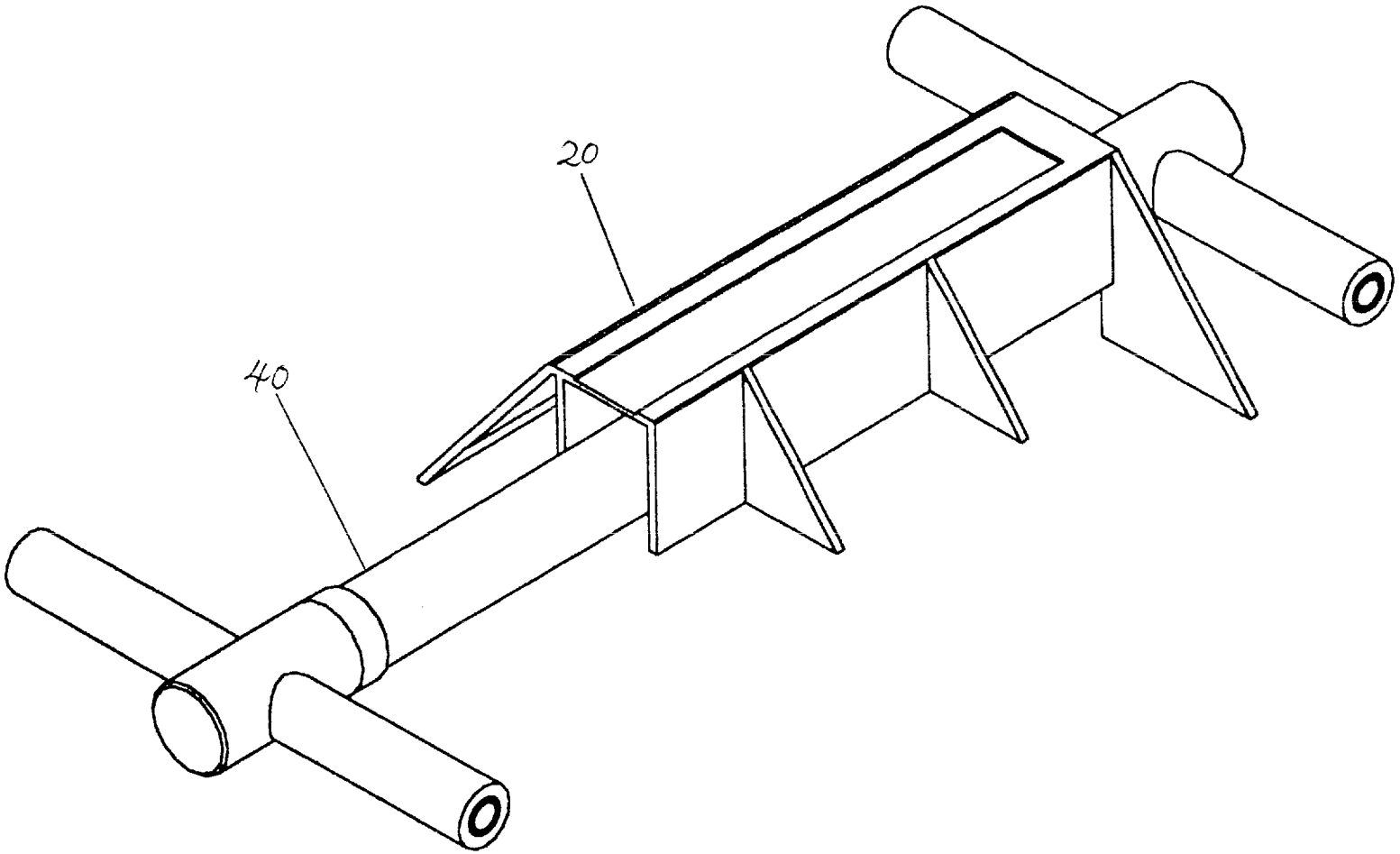
FIG. 7 is an alternate embodiment of the footrest.
Figure 8:
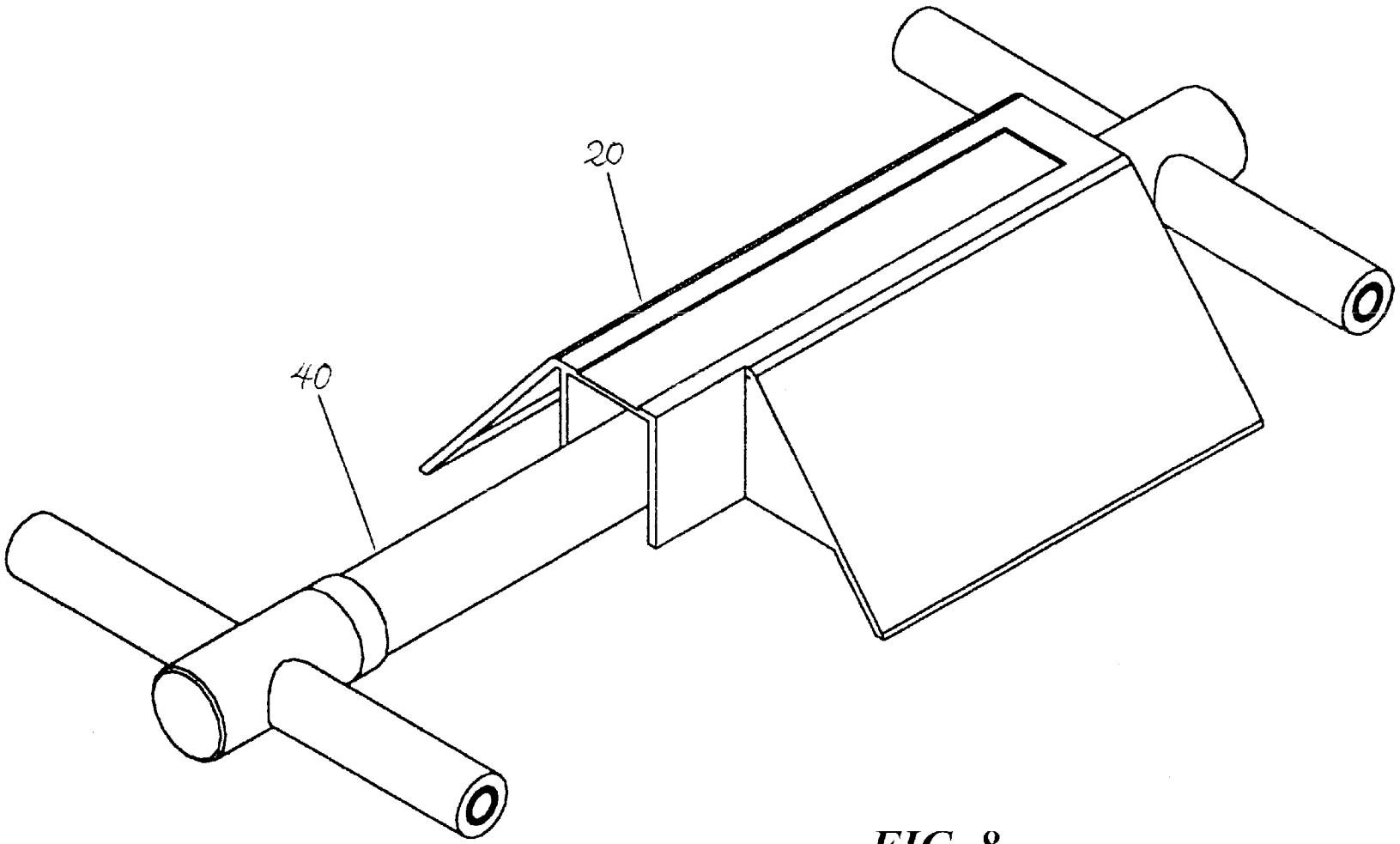
FIG. 8 is an alternate embodiment of the footrest.

Referring now to FIGS. 7 and 8, it should be appreciated that the configuration of the footrest 20 can vary and can be structured for use by one person. It should also be appreciated that the length of the footrest 20 may vary to accommodate more than two exercisers at one time.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A portable exercise apparatus comprising:

an elongated bar having a first end and an opposite second end, said first and second ends each having a handle secured thereto in perpendicular relation to a longitudinal axis of said elongated bar; and a footrest having a pair of longitudinally disposed sidewalls for supporting feet of exercisers, said sidewalls projecting downwards and outward from a top which connects said sidewalls; and a pair of opposing endwalls, each of said endwalls having an opening, wherein said elongated bar is removably attached to said footrest through said openings of said endwalls for storage and transportation.

2. The portable exercise apparatus of claim 1, wherein said elongated bar comprises an inner tubular member and an outer tubular member arranged telescopically, and means for adjusting the length of said elongated bar.

3. The portable exercise apparatus of claim 2 wherein said means for adjusting the length of said elongated bar comprises a plurality of spaced apart pairs of holes disposed along opposite sides of said inner tubular member and said outer tubular member, and a pin, said pin being removably inserted in one set of said pairs of holes aligned between said inner tubular member and out tubular member to maintain said elongated bar in a certain length.

4. The portable exercise apparatus of claim 1, wherein said footrest further comprises a support structure between said sidewalls, said support structure having an opening for adapting said elongated bar.

5. A method of physical exercise comprising the steps of:

(a) placing a portable- exercise apparatus between two persons, wherein said apparatus comprising a footrest having a pair of longitudinally disposed sidewalls, said sidewalls projecting downwards and outward from a top which connects said sidewalls; and an elongated bar having a first end and an opposite second end, said first and second ends each having a handle secured thereto in perpendicular relation to a longitudinal axis of said elongated bar;

(b) said two persons sitting on opposite sides of said footrest with their feet positioned against said sidewalls, and each gripping one of said handles and alternating between a first position wherein a first person is reclined prone backwards and a second person is sitting upright to a second position wherein said first person is sitting upright and said second person is reclined prone backwards.

6. The method of physical exercise of claim 5, wherein said elongated bar further includes means for adjusting the length of said elongated bar.

7. A method of physical exercise comprising the steps of:

(a) placing a footrest between two persons, said footrest having a pair of longitudinally disposed sidewalls projecting downwards and outward from a top which connects said sidewalls, wherein said two persons sit on opposite sides of said footrest with their feet positioned against said sidewalls, and (b) holding an elongated means through a handle in hands of each of said persons, said elongated means having two ends, and said handles secured thereto in perpendicular relation to each end of said elongated means:

(c) said two persons pulling said elongated means and alternating between a first position wherein a first person is reclined prone backwards and a second person is sitting upright to a second position wherein said first person is sitting upright and said second person is reclined prone backwards.

8. The method of physical exercise of claim 7, wherein said elongated means further includes means for adjusting the length of said elongated means.

* * * * *